US005305998A

United States Patent [19]

Nesbit et al.

[11] Patent Number: 5,305,998

[45] Date of Patent: * Apr. 26, 1994

[54] ILLUMINATED BASKETBALL BASKET RIM AND ILLUMINATED BASKETBALL BACKBOARD

[76] Inventors: Charles E. Nesbit, 9206 Willard Ct., Des Moines, Iowa 50322; Mark S. Nesbit, 1248 - 17th St., West Des Moines, Iowa 50265

[ * ] Notice: The portion of the term of this patent subsequent to Jan. 15, 2008 has been disclaimed.

[21] Appl. No.: 501,483

[22] Filed: Mar. 3, 1990

Related U.S. Application Data

[63] Continuation-in-part of Ser. No. 327,597, Mar. 23, 1989.

[51] Int. Cl.[5] ..... A63B 63/08

[52] U.S. Cl. ..... 273/1.5 R; 362/32; 362/253

[58] Field of Search ..... 273/1.5 R, 55 D, 424, 273/DIG. 24, 408, 348; 315/360; 362/253, 32

[56] References Cited

U.S. PATENT DOCUMENTS

| | | | |
|---|---|---|---|
| 280,807 | 7/1883 | Farley | 273/DIG. 24 X |
| 2,346,428 | 4/1944 | Hanley | 362/253 X |
| 2,479,500 | 8/1949 | Longberg | 362/32 |
| 2,568,279 | 9/1951 | Franz et al. | 273/DIG. 24 X |
| 3,215,912 | 11/1965 | Bruno | 273/1.5 R X |
| 3,648,107 | 3/1972 | Rydborn | 315/360 |
| 3,709,495 | 1/1973 | Krombein | 213/348 X |
| 3,825,261 | 7/1974 | Zapos | 273/55 D |
| 3,918,719 | 11/1975 | Welch | 273/DIG. 24 X |
| 4,204,149 | 5/1980 | Cleary et al. | 315/350 X |
| 4,248,010 | 2/1981 | Fox | 273/424 X |
| 4,361,767 | 11/1982 | Pelka et al. | 315/360 X |
| 4,369,486 | 1/1983 | Pool | 362/32 |
| 4,422,719 | 12/1983 | Orcutt | 362/32 X |
| 4,425,532 | 1/1984 | Sinkauz | 315/360 |
| 4,431,196 | 2/1984 | Kutnyak | 273/424 |
| 4,461,977 | 7/1984 | Pierpont et al. | 315/360 X |
| 4,492,049 | 1/1985 | Gaylor | 273/1.5 R X |
| 4,500,795 | 2/1985 | Hochstein et al. | 315/360 X |
| 4,736,955 | 4/1988 | Pollock | 273/DIG. 24 X |
| 4,846,475 | 7/1989 | Newcomb et al. | 273/DIG. 24 X |
| 4,858,920 | 8/1989 | Best | 273/1.5 R |
| 4,901,209 | 2/1990 | Nitz | 362/32 |

FOREIGN PATENT DOCUMENTS

| | | | |
|---|---|---|---|
| 2137515 | 2/1973 | Fed. Rep. of Germany | 362/253 |
| 2445465 | 9/1980 | France | 273/DIG. 24 |
| 2446465 | 9/1980 | France | 273/DIG. 24 |
| 587980 | 5/1947 | United Kingdom | 273/408 |

*Primary Examiner*—Paul E. Shapiro
*Attorney, Agent, or Firm*—Henderson & Sturm

[57] ABSTRACT

A basketball basket rim having an illumination lights that combined with an illuminated basketball backboard would aid those involved with the sport when used in low light areas and areas without lighting systems.

18 Claims, 2 Drawing Sheets

ILLUMINATED BASKETBALL BASKET RIM AND ILLUMINATED BASKETBALL BACKBOARD

This is a continuation-in-part Application of pending U.S. patent application Ser. No. 07/327,597 filed Mar. 23, 1989.

TECHNICAL FIELD

This invention relates to the game of basketball and more particularly to illuminated basketball baskets which are sometimes referred to as the hoop or the goal.

The basketball backboard would also incorporate an illuminating light source.

BACKGROUND ART

There are many prior art devices related to the development of the game of basketball. There are also many prior art devices relating to the illumination of basketball courts and arenas. One problem associated with the prior art devices where the basketball basket is concerned is that at night the basket becomes hard to see because of its height above the ground compared to most outdoor home lighting systems. Also, if a person wants to play basketball at night and there is no outdoor lighting, by being able to illuminate the basketball backboard and basket rim, the players will be able to play the game.

Those concerned with these and other problems recognize the need for an improved illuminated basketball basket and backboard.

DISCLOSURE OF THE INVENTION

The present invention provides an illuminated basketball basket and backboard. The rim of the basket would house an illuminating light source such as a string of lights, fiber optics or any other type of light known in the art.

The lighting system for the basket would be encased inside of the rim for protection from the elements and from the basketball itself. The basketball rim could be manufactured of metal with a hollow interior into which the illuminating light source would be installed.

The conventional metal basketball rim would have cut outs around the rim's circumference which would allow the light source to shine through the cut outs located along the basket rim, and would have transparent protection covers or coverings which help to protect the lighting system.

The basketball backboard would have illuminating means molded into its construction or mounted behind the backboard itself, which would have to be manufactured of a semi-transparent or transparent material for the illuminating light source to be useful.

The power source for illuminating the basketball rim and backboard would be either A/C, D/C, Solar or any combination of these.

In another embodiment, the basket rim would be manufactured of transparent synthetic materials which would allow the illuminating light source housed inside of the rim to shine through.

An object of the present invention is the provision of an improved illuminated basketball basket rim prewired with lights or fiber optics.

Another object of the present invention is to provide an illuminated basketball backboard and illuminated basket rim that are rugged and will stand up to abuse.

A further object of the present invention is to provide an illuminated basketball backboard and basket rim that are easy to use.

Still another object of the present invention is the availability of different illuminating colors.

A still further object of the present invention is to provide switching ability so that the illuminated basketball backboard and illuminated basket rim lighting can be turned on and off.

Yet another object of the present invention is the provision of an illuminated basketball backboard and an illuminated basket rim that are inexpensive to manufacture.

A yet further object of the present invention is the provision of a photocell override of the on/off switching means wherein the illumination means cannot be activated until a low ambient light level is sensed by the photocell.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 4 is a perspective view of a standard basketball rim equipped with cut outs to allow illuminating means to shine through;

BEST MODE FOR CARRYING OUT THE INVENTION

Figure 1:
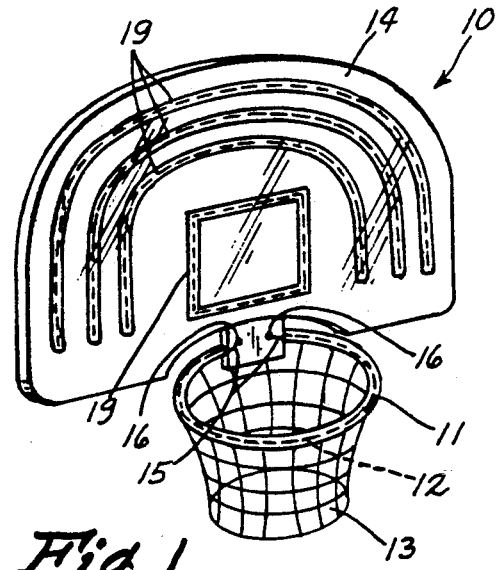
FIG. 1 is a perspective view of an illuminated basketball backboard with an attached illuminated basket rim.

Referring now to the drawings, wherein like reference numerals designate identical or corresponding parts throughout the several views, FIG. 1 shows the basketball backboard and basket generally at (10). The illumination lighting (12) is housed inside the transparent basket rim (11). The wiring (15) passes through openings (16). Shown on the front of the backboard (14) are illumination means (19).

Figure 2:
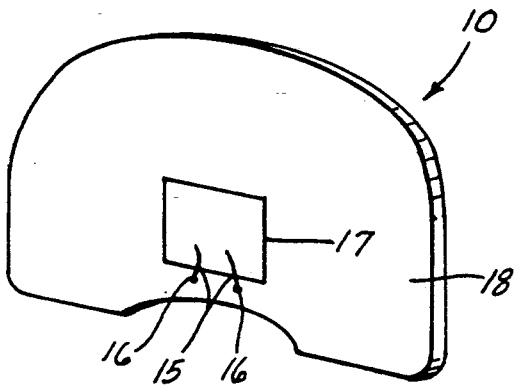
FIG. 2 is a perspective view of the backside of an illuminated basketball backboard and rim showing a power source location.

FIG. 2 shows the backside of the basketball backboard (18) with a power source container (17) mounted to the backboard (18), the illumination wiring (15) passing through openings (16) and connecting to the power source (17).

Figure 3:
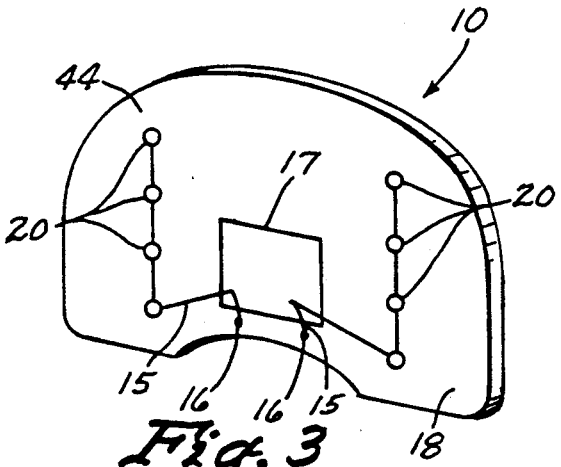
FIG. 3 is a perspective view of the backside of a basketball backboard showing another type of illuminating means mounted to the backside of a transparent basketball backboard.

FIG. 3 shows the backside view of a basketball backboard (18) with a power source container (17) that supplies power for the illumination lighting (20) which is mounted on the backside of the backboard (18). The wiring (15) connects the power source (17) with the illuminating means (20). The backboard (14) would include a transparent portion (44) to allow for illumination from behind.

Figure 4:
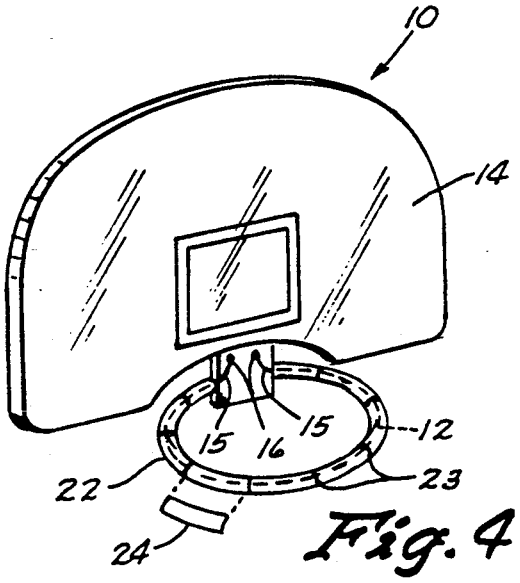

FIG. 4 shows a backboard generally at (10). The front of the backboard (14) and a metal basket rim (22) having a hollow interior housing an illumination means (12). The metal basket rim (22) would have cut out openings (23) around its circumference to allow the illumination lighting (12) to shine through. The cut out openings (23) would have transparent covers or coverings (24) to protect the illumination lighting (12).

Figure 5:
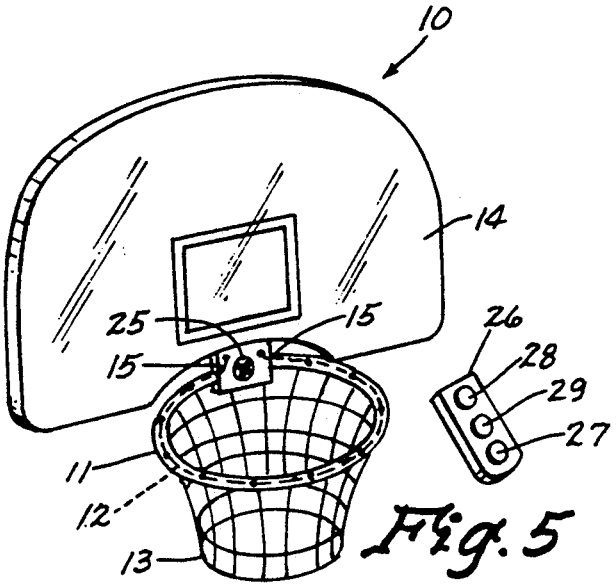
FIG. 5 is a perspective view of a remote control system installed to control the illuminating functions of the illuminated basketball backboard and illuminated basket rim.

FIG. 5 shows a backboard generally at (10), the front of the backboard (14), and a remote control unit (26) with an on button (28), an off button (29) and a dimmer control (27). A remote control receiver (25) is mounted to the backboard (14). Illumination lighting (12) is housed inside the transparent basket rim (11).

Figure 6:
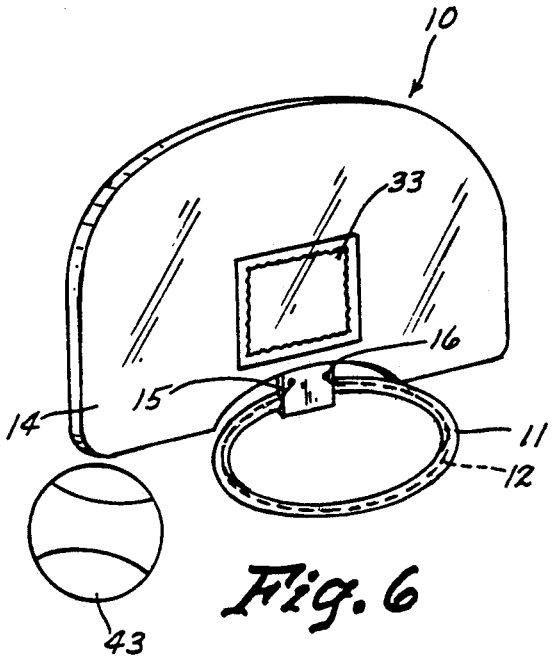
FIG. 6 is a perspective view of a pressure activated switch control system mounted to an illuminated basketball backboard.

FIG. 6 shows the basketball backboard generally at (10), the front of the backboard (14) and a pressure switch contact (33) located either on the backboard front (14) or the basket rim (11). The pressure switch contact (33) would turn on the illumination lighting (12) when an object such as a basketball (43) were to hit the backboard front (14) or the basket rim (11). If no contact is made by the basketball (43) for a determined time span, the power source (17) would shut off power to the illuminating means via a time delay means (47). To accomplish the purpose of this invention which is to provide an illuminated backboard and rim for a continuous period of time while players are taking multiple shots at the backboard and basket 10, the illumination means, once actuated, will stay on for a period of time that is not less than fifteen (15) seconds so that the illumination means will be continuously lit during the time normally required for a player to make three baskets or more.

Figure 7:
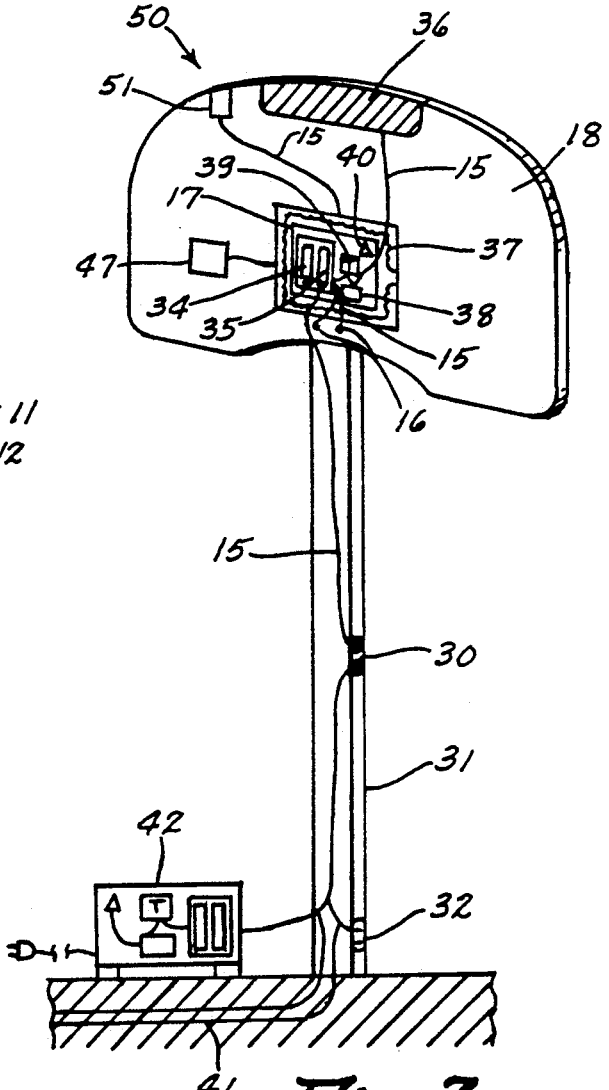
FIG. 7 is a perspective view of the backside of an illuminated basketball backboard and illuminated basket rim power source and mounting system.

FIG. 7 shows the backside of a backboard (18). The power source container (17) would be waterproof and mounted to shock absorbent buffer material (37). Housed inside the power source container would be a battery compartment (34) with batteries (35) inside. A transformer (39), a rechargeable battery (38), and a timer would all interconnect and would be housed inside the power source container (17). A solar collector (36) connects by wiring (15) to the power source (17). A pole mount (31) would incorporate a on/off switch (30) on the pole (31). A recharging plug-in (32) is connected by wiring (15) to the power source (17). Buried underground wiring (41) could also be used to supply power to the power source container (17). An optional waterproof ground based power source (42) could also be used and would eliminate the power source container (17) mounted to the rear side of the backboard (18). It is to be understood that the optional ground based power source (42) would provide all of the same features of the power source container (17).

As mentioned earlier on in the specification, this invention is designed to provide illumination in areas that have very little, if any, artificial lighting. To that end, as can be seen by reference to FIG. 7, this invention contemplates the inclusion of an ambient light detection means (50) operably associated with the an/off switch (30) and the pressure contact switch (33) via wiring (15).

The ambient light detection means (50) further includes a photocell detector (51) which is sensitive to the ambient light level and which will prevent the illumination lighting (12) from being turned on until a certain low ambient light level is detected by the photocell, whereby the illumination light (12) can only be energized during periods of low light to both conserve energy and prolong the useful life of the illumination lights.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

We claim:

1. In a basketball backboard and basketball rim combination an improvement comprising:

an illumination means in the form of illumination lights contained within both the basketball rim and portions of the basketball backboard wherein both said rim and backboard are provided with transparent surfaces that will permit the transmission of light from the said illumination lights;

switching means for controlling the an/off actuation of said illumination means; and, light detection means operable to override the said switching means in response to a sensed condition.

2. The improvement as in claim 1 wherein said switching means includes pressure sensitive means associated with a selected one of the rim and the backboard for controlling the on/off actuation of said illumination means.

3. The improvement as in claim 2 wherein said switching means further includes time delay means operatively associated with said pressure sensitive means for controlling the on/off actuation of said illumination means.

4. The improvement as in claim 1 wherein said light detection means includes a photocell for sensing the ambient light conditions wherein, said illumination means cannot be turned on until a predetermined low ambient light level is sensed.

5. In a basketball backboard and basketball rim combination an improvement comprising:

an illumination means in the form of illumination lights contained within the basketball rim and wherein said rim is provided with transparent surfaces that will permit the transmission of light from the said illumination lights;

switching means for controlling the on/off actuation of said illumination lights; and light detection means operable to override the said switching means in response to a sensed condition.

6. The improvement as in claim 5 wherein said switching means includes pressure sensitive means associated with a selected one of the rim and the backboard for controlling the on/off actuation of said illumination means.

7. The improvement as in claim 6 wherein said switching means further includes time delay means operatively associated with said pressure sensitive means for controlling the on/off actuation of said illumination means.

8. The improvement as in claim 5 wherein said light detection means includes a photocell for sensing the ambient light conditions wherein, said illumination means cannot be turned on until a predetermined low ambient light level is sensed.

9. In a basketball backboard and basketball rim combination an improvement comprising:

an illumination means in the form of illumination lights contained within portions of the basketball backboard wherein said backboard is provided with transparent surfaces that will permit the transmission of light from the said illumination lights;

switching means for controlling the on/off actuation of said illumination means; and light detection means operable to override the said switching means in response to a sensed condition.

10. The improvement as in claim 9 wherein, said switching means includes pressure sensitive means associated with a selected one of the rim and the backboard for controlling the on/off actuation of said illumination means.

11. The improvement as in claim 10 wherein said switching means further includes time delay means operatively associated with said pressure sensitive means for controlling the on/off actuation of said illumination means.

12. The improvement as in claim 9 wherein said light detection means includes a photocell for sensing the ambient light conditions wherein, said illumination means cannot be turned on until a predetermined low ambient light level is sensed.

13. In a basketball backboard and rim combination, the improvement comprising:

a transparent backboard;

first means molded into said backboard for providing illumination of the entire backboard;

a rim secured to said backboard and extended outwardly therefrom substantially normal to the plane of said backboard;

second means attached within said rim for providing illumination thereto; and manually operable means for activating an on/off actuation of said first and said second means for illumination of said backboard and rim.

14. The invention of claim 13, and further wherein said first means is formed on said backboard with a predetermined pattern for illumination purposes, said pattern including vertically disposed components.

15. The invention of claim 13, and further wherein said first illumination means includes one or more elements mounted on the backside of said backboard and contiguous therewith.

16. The invention of claim 13, and further wherein said rim is comprised of transparent material and is provided with a hollow interior for housing said second illumination means.

17. The invention of claim 13, and further wherein said first means comprises a light source remote from said backboard and light transmitting elements molded into said backboard for receiving illumination from said light source.

18. In a basketball backboard and rim combination, the improvement comprising:

a transparent backboard having a front surface and a back surface;

first means secured in a contiguous manner to said front surface for providing illumination of the entire backboard;

a source of electrical energy for said first means secured to said back surface and inserted through said backboard for connection with said first means;

a rim secured to said backboard and extended outwardly therefrom substantially normal to the plane of said backboard; and manually operable means for activating an on/off actuation of said first means for illumination only of said backboard.

* * * * *